US005733237A

United States Patent [19]

Marschke et al.

[11] Patent Number: 5,733,237

[45] Date of Patent: Mar. 31, 1998

[54] APPARATUS FOR FOLDING PAPER ITEMS

[75] Inventors: Steve Marschke, 2956 Summerfield Dr., West Sacramento, Calif. 95691; Scott M. Perry, Auburn, Calif.

[73] Assignee: Steve Marschke, West Sacramento, Calif.

[21] Appl. No.: 487,597

[22] Filed: Jun. 7, 1995

[51] Int. Cl.[6] ..... B65H 45/12

[52] U.S. Cl. ..... 493/405; 493/456

[58] Field of Search ..... 493/405, 162, 493/243, 395, 396, 397, 398, 399, 408, 458, 473, 476, 917, 952, 953, 456

[56] References Cited

U.S. PATENT DOCUMENTS

| | | | |
|---|---|---|---|
| 192,102 | 6/1877 | Watriss . | |
| 623,882 | 4/1899 | Cameron . | |
| 747,085 | 12/1903 | Rieffel . | |
| 797,864 | 8/1905 | Naylor . | |
| 1,164,844 | 12/1915 | Mudge . | |
| 1,346,109 | 7/1920 | Astley . | |
| 1,424,881 | 8/1922 | Cowen . | |
| 1,678,917 | 7/1928 | Roush . | |
| 1,806,125 | 5/1931 | Spohn | 493/405 |
| 2,549,386 | 4/1951 | Reigh . | |
| 2,918,276 | 12/1959 | Weston . | |
| 2,988,251 | 6/1961 | Ziegler | 223/37 |
| 3,092,379 | 6/1963 | Collier . | |
| 3,144,182 | 8/1964 | Freeman | 223/37 |
| 3,448,557 | 6/1969 | Swaithes | 223/37 |
| 3,514,097 | 5/1970 | Hoff . | |
| 4,421,500 | 12/1983 | Smith . | |
| 5,057,070 | 10/1991 | Pidcock | 493/405 |
| 5,308,051 | 5/1994 | Spitzmesser . | |
| 5,380,265 | 1/1995 | Giovinazzo | 493/405 |
| 5,417,641 | 5/1995 | Warren | 493/405 |

*Primary Examiner*—Joseph J. Hail, III
*Assistant Examiner*—Christopher W. Day
*Attorney, Agent, or Firm*—John P. O'Banion

[57] ABSTRACT

A paper holding tray having a generally flat top surface, and a generally flat folding guide included on the top surface of the tray. The paper holding tray generally includes front and back edges, first and second sides, and first and second truncated corners adjacent the front edge. Preferably, a pair of parallel ridges extend between the front and back edges of the tray and the folding guide fits in between. Rear wall members are included on the top surface of the tray adjacent to the back edge. First and second side wall members are included on the top surface adjacent the first and second sides respectively. The rear wall members and side wall members form a generally contiguous lip about the sides and back edges of the tray and define a paper receiving recess on the top surface of the tray. A slot between the rear wall members accommodates one end of the folding guide, the other end of which extends out over the front edge of the tray. In a second embodiment, front wall members are included on the top surface of the tray adjacent the front edge. The front wall members are discontinuous with the first and second side wall members so that openings are formed at the first and second truncated corners. The front wall members include a slot through which the first end of the folding guide fits.

14 Claims, 10 Drawing Sheets

APPARATUS FOR FOLDING PAPER ITEMS

BACKGROUND OF THE INVENTION

1. Field of the Invention

The present invention pertains generally to folding devices for sheet items, and more particularly to an apparatus for folding paper items to be mailed into sizes and shapes suitable for insertion into mailing envelopes.

2. Description of the Background Art

Businesses and organizations which send out large amounts of mail correspondence employ a variety of mail preparation devices and systems to increase speed of mail processing and reduce labor costs associated therewith. Mechanized and computer directed mass mailing devices are available which can fold and process large numbers of mail items quickly and precisely, but many smaller businesses and organizations neither need nor can afford such elaborate systems. To satisfy the needs of such small businesses and organizations, several manual or hand-operated folding devices have been developed which allow folding of mail items more quickly and accurately than possible by hand alone. However, a number of deficiencies have become apparent in the aforementioned background art. For example, many of these devices employ moving blade and plate members which can trap and injure the fingers of persons using the devices. Die and mandrel arrangements particularly pose such a hazard. An additional drawback is that many devices require adjustment before use. Further, some devices are time consuming and complicated to use, involving positioning of blades and pivoting of hinged parts. An additional result of such complexity is expense in manufacturing of the devices. Yet another deficiency is the unaesthetic, mechanical appearance of many available devices, which makes them unsuitable for use on office desks or areas where business customers and clients are present.

Thus, there is a need for an apparatus for folding paper items which is safe to use, which requires no adjustment before use, which is quick and easy to use, which is inexpensive to manufacture, and which is aesthetically pleasant and suitable for formal work environments. The present invention satisfies these needs, as well as others, and generally overcomes the deficiencies found in the presently known paper folding art.

SUMMARY OF THE INVENTION

This invention pertains to a hand-operated apparatus for folding of paper items which is quick and easy to use, which is inexpensive to manufacture, which reduces the risk of harm to the user's fingers, and which is aesthetically pleasant.

In general terms, the invention includes a paper holding tray with a generally flat top surface, and a generally flat folding guide included on the top surface of the tray. By way of example, and not of limitation, the paper holding tray generally includes front and back edges and first and second sides, with the corners adjacent the front edge cut away to form first and second truncated corners. Preferably, a pair of parallel longitudinal ridges on the top surface of the tray extend between the front and back edges and form an area for the folding guide to fit within. The folding guide is generally rectangular, has first and second ends, and is preferably pivotally attached to the tray by articulating means. First and second rear wall members are included on the top surface of the tray adjacent to the back edge, with a slot defined between the rear wall members. First and second side wall members are included on the top surface adjacent the first and second sides respectively. The rear wall members and side wall members together form an upwardly disposed lip, skirt, or rail which runs along the sides and back edge of the paper receiving tray, generally defining a recess on the top surface of the tray for positioning and registering the paper for folding. The first end of the folding guide extends out over the front edge of the tray, while the second end of the folding guide fits in the slot between the rear wall members.

In an alternative embodiment of the invention, first and second front wall members are included on the top surface of the tray adjacent the front edge. The front wall members are discontinuous with the first and second side wall members so that openings in the paper receiving recess are defined at the first and second truncated corners. A slot is included between the front wall members through which the first end of the folding guide fits.

The subject invention is used by placing one or more rectangular sheets of paper, parchment, vellum, or like creasable sheet material, into the paper receiving recess of the paper holding tray so that two adjacent corners of the paper sheets protrude out of the holding tray over the truncated corners. The folding guide is placed over the paper sheets, with the second end of the guide pivotally attached to the tray top surface in the slot between the rear wall members. The user grasps the corners of the top sheet protruding over the truncated corners, lifts the corners up over the folding guide, and presses the paper down on the folding guide to form a crease in the desired position. The folded paper sheet is removed by lifting the folding guide slightly at the front edge, and sliding the folded paper sheet off the folding guide.

An object of the invention is to provide an apparatus for folding paper items which is quick and easy to use.

Another object of the invention is to provide an apparatus for folding paper items which will not trap and injure the fingers of persons using the apparatus.

Another object of the invention is to provide an apparatus for folding paper items which is simple and inexpensive to manufacture.

Another object of the invention is to provide an apparatus for folding paper items which does not require adjustment for each use.

Another object of the invention is to provide an apparatus for folding paper items which aesthetically pleasant and suitable for use in formal work environments.

Further objects and advantages of the invention will be brought out in the following portions of the specification, wherein the detailed description is for the purpose of fully disclosing the invention without placing limits thereon.

BRIEF DESCRIPTION OF THE DRAWINGS

The invention will be more fully understood by reference to the following drawings which are for illustrative purposes.

DESCRIPTION OF THE PREFERRED EMBODIMENTS

Referring more specifically to the drawings, for illustrative purposes the present invention is embodied in the apparatus generally shown in FIG. 1 through FIG. 13. It will be appreciated that the invention may vary as to configuration and as to details of the parts without departing from the basic concepts as disclosed herein.

Figure 1:
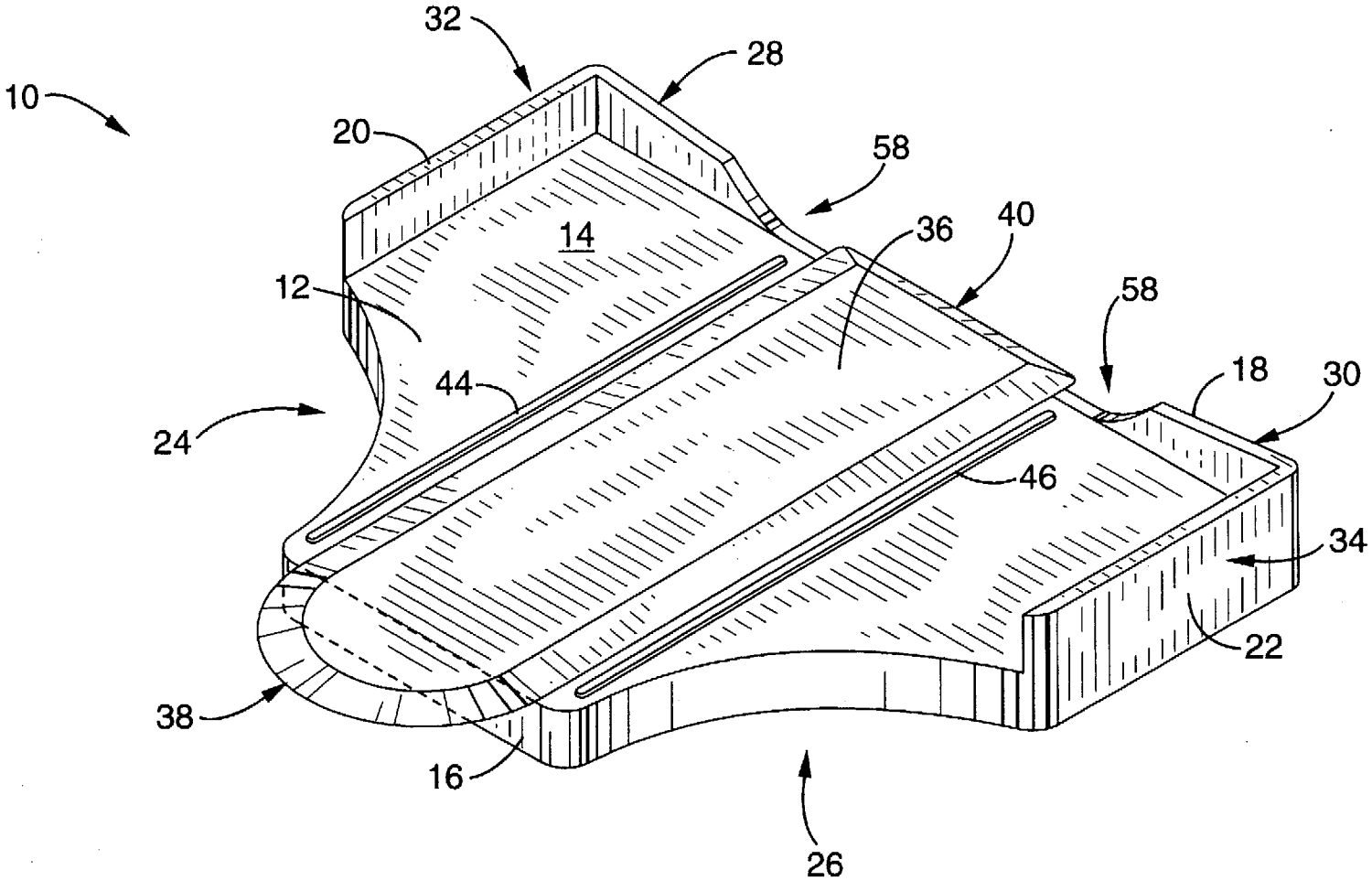
FIG. 1 is a perspective view of an apparatus for folding paper items in accordance with the present invention.
Figure 2:
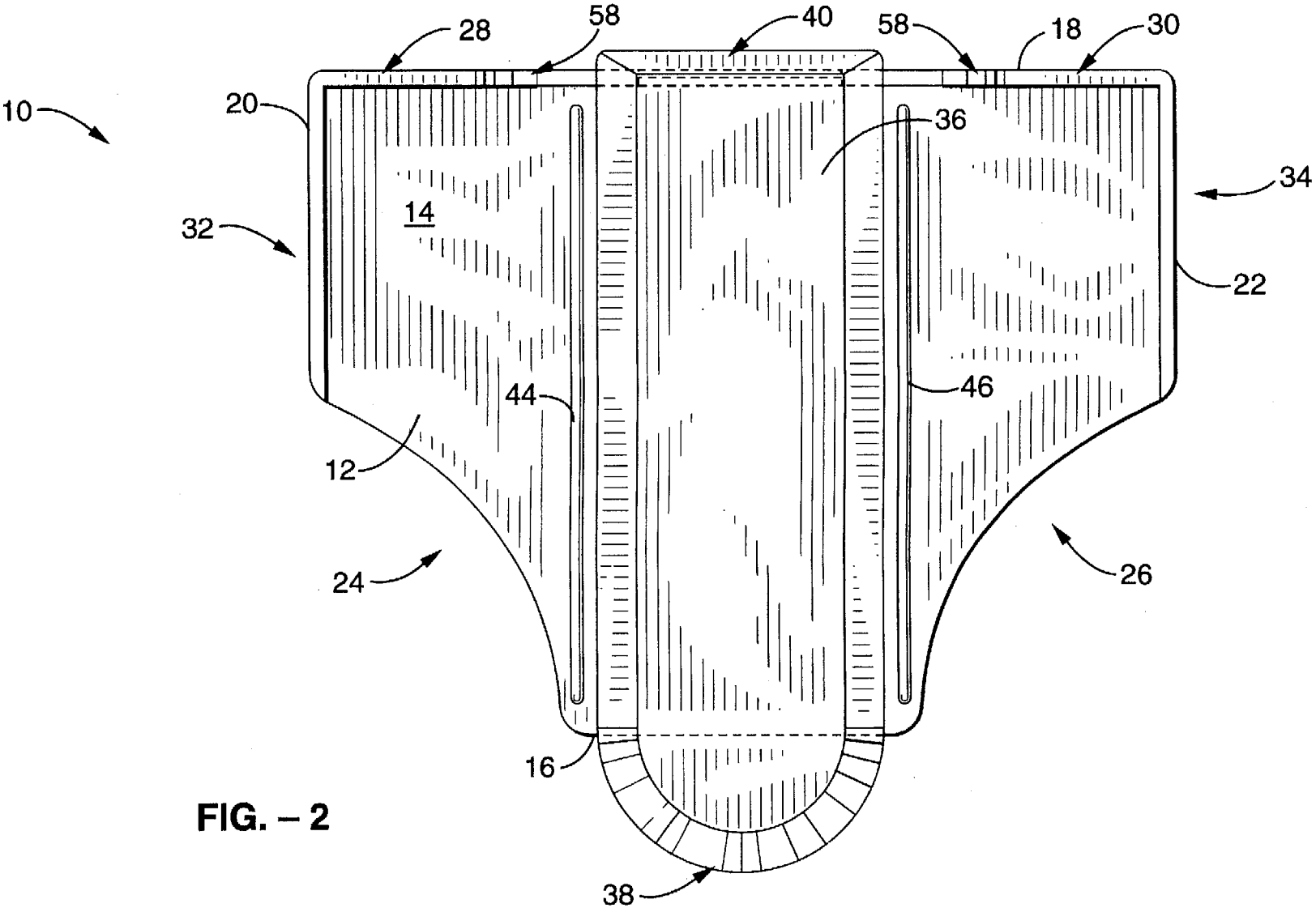
FIG. 2 is a top plan view of the apparatus shown in FIG. 1
Figure 3:
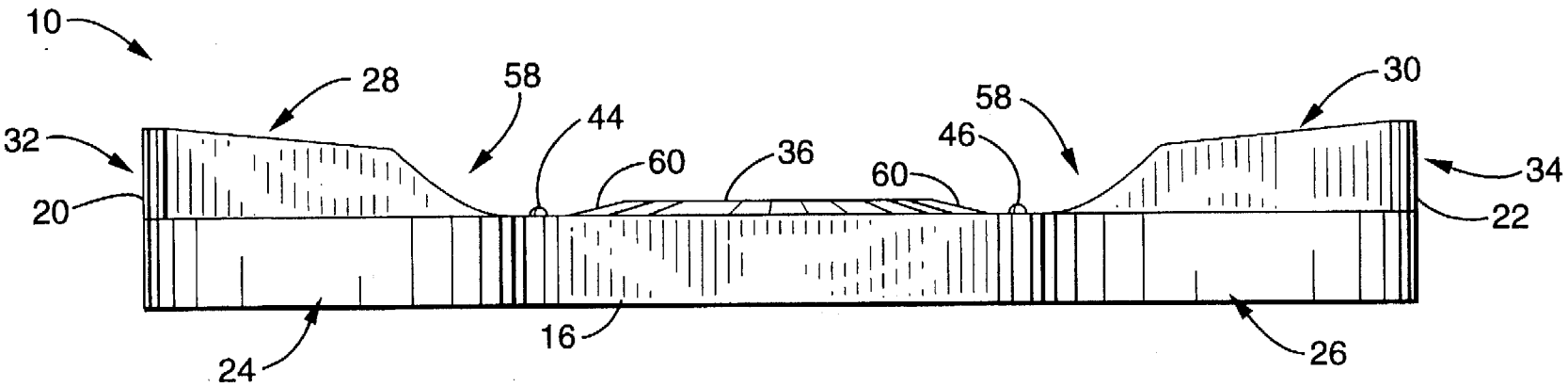
FIG. 3 is a front view of the apparatus shown in FIG. 1.
Figure 4:
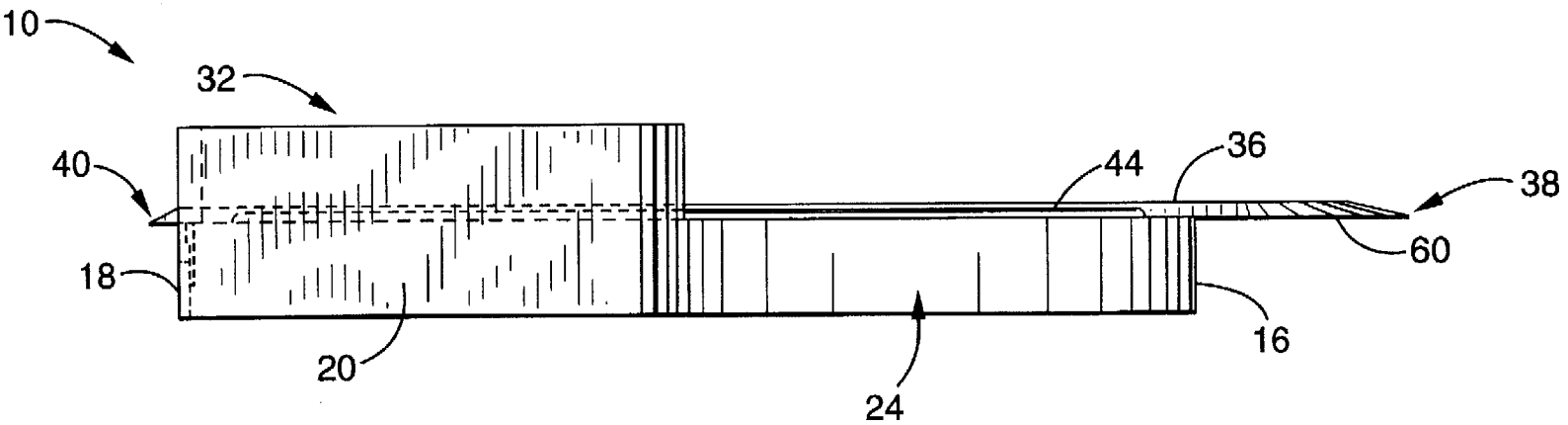
FIG. 4 is a side view of the apparatus shown in FIG. 1.
Figure 5:
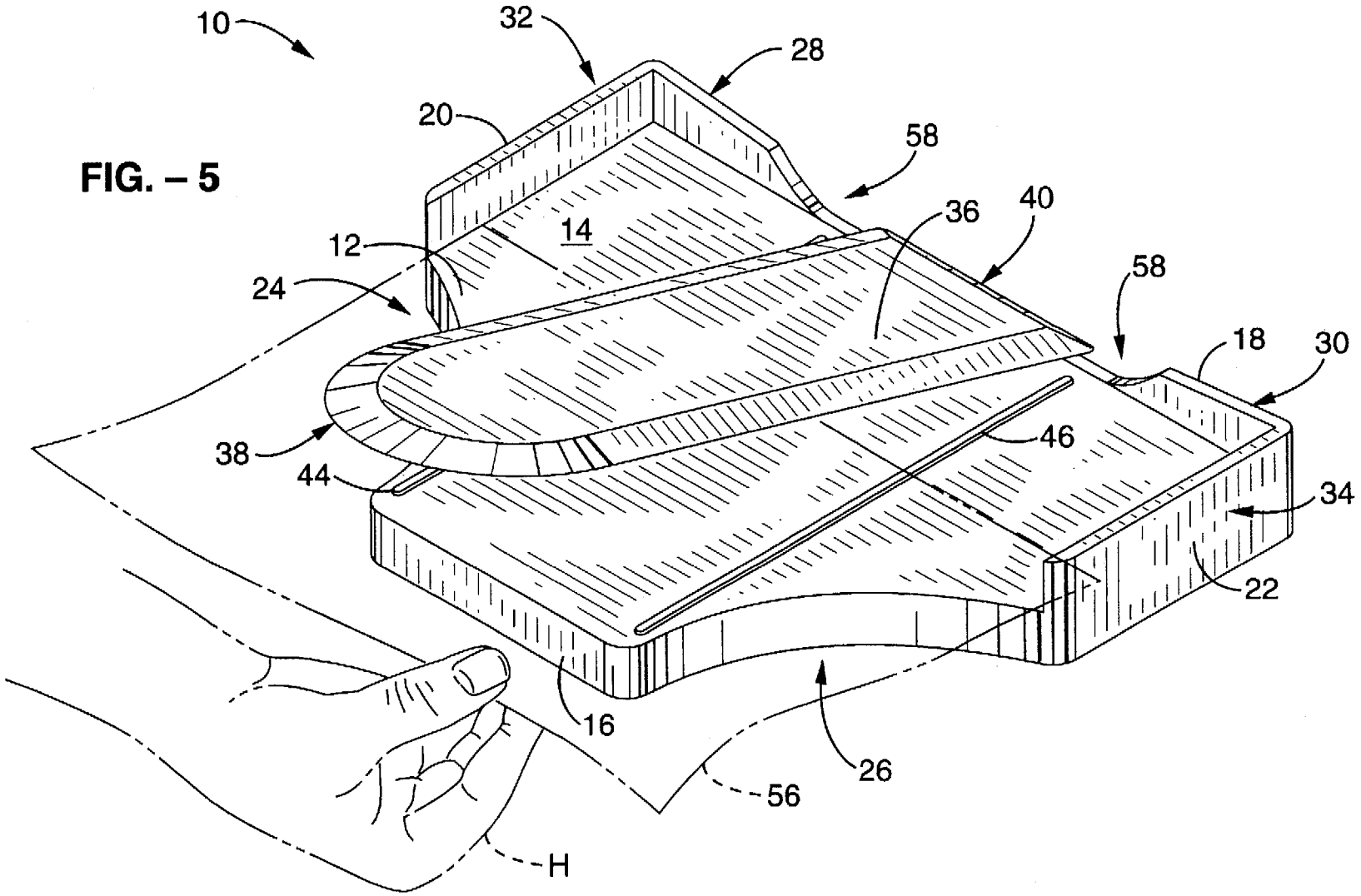
FIG. 5 is a perspective view of the apparatus shown in FIG. 1, showing a user inserting paper sheets into the apparatus.
Figure 6:
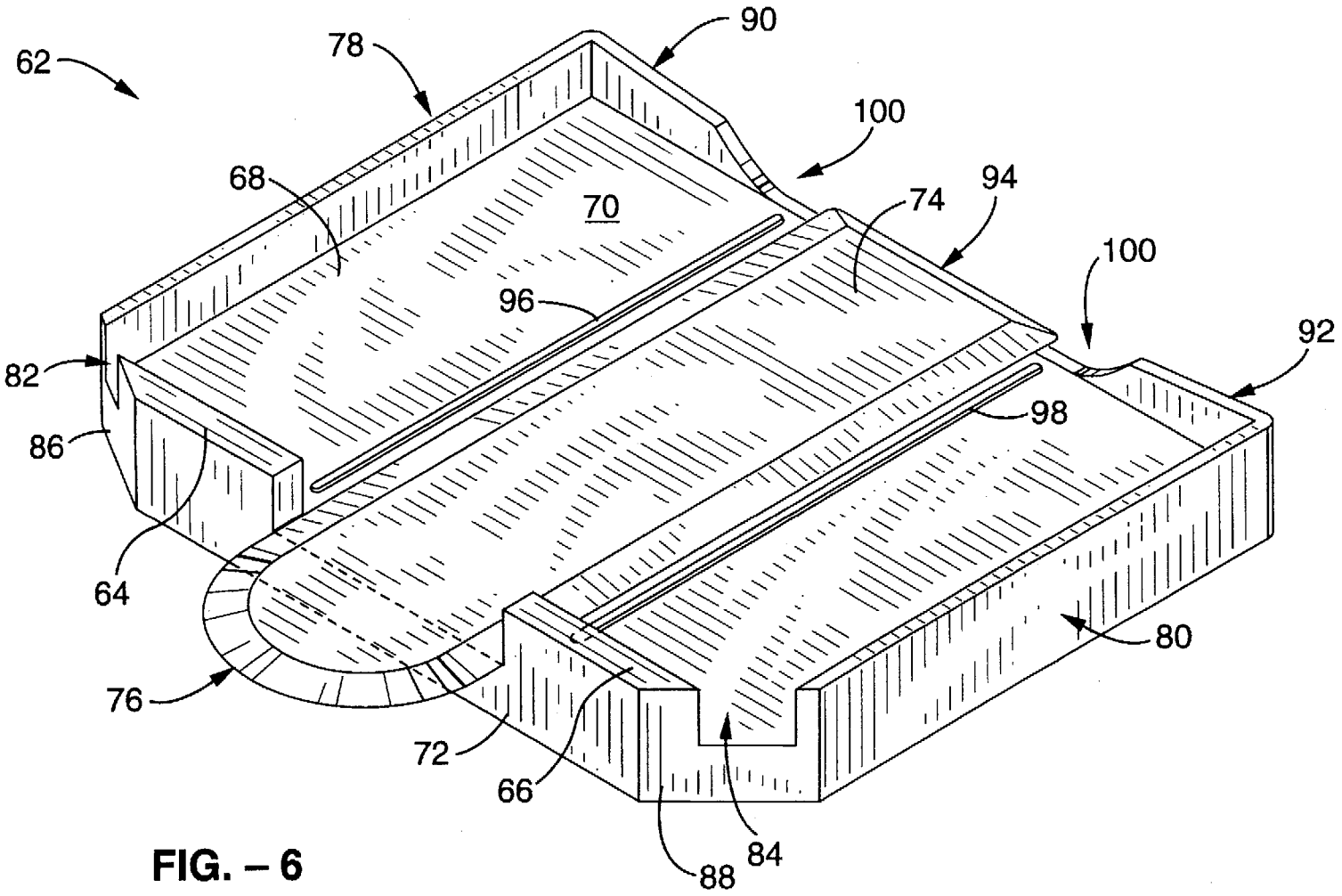
FIG. 6 is a perspective view of an alternative embodiment of the apparatus of the present invention.
Figure 7:
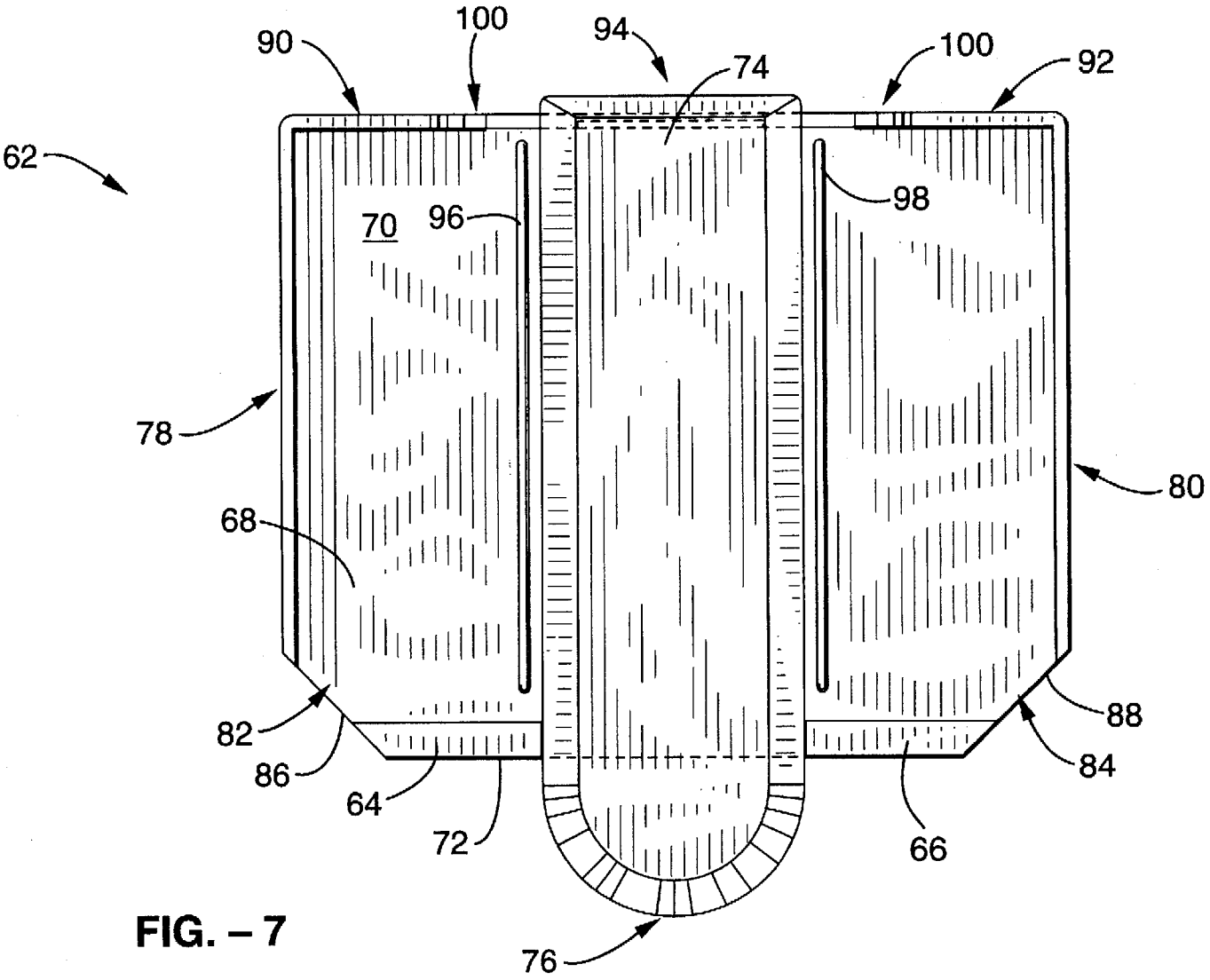
FIG. 7 is a top plan view of the apparatus shown in FIG. 6.
Figure 8:
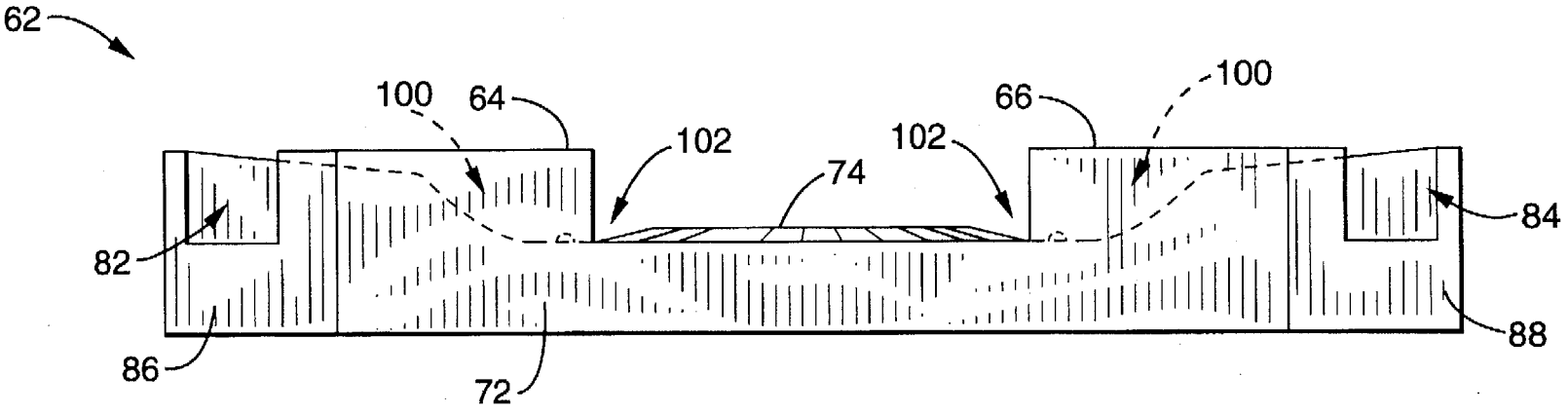
FIG. 8 is a front view of the apparatus shown in FIG. 6.
Figure 9:
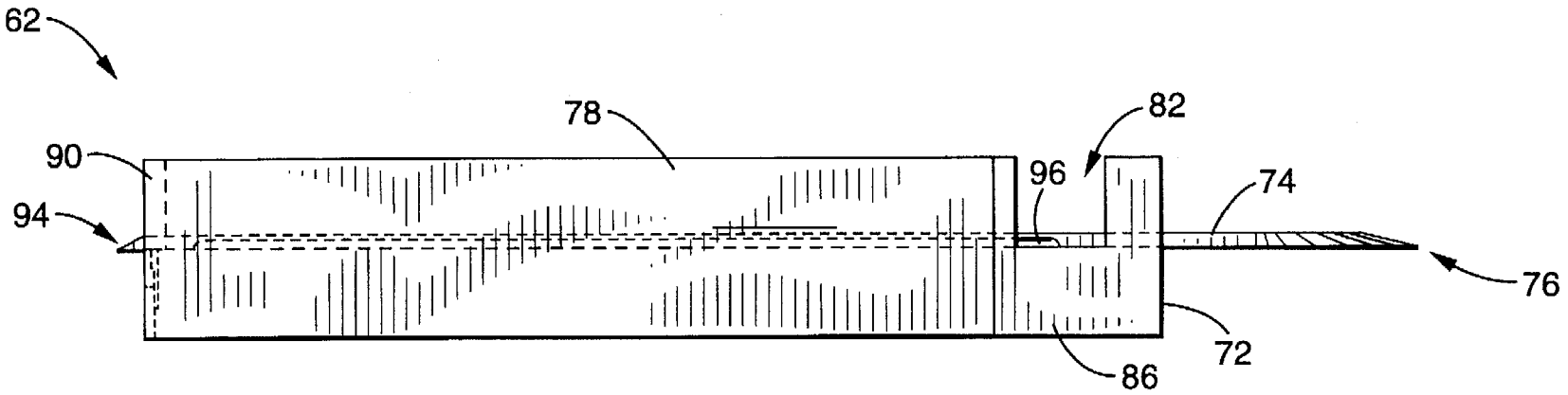
FIG. 9 is a side view of the apparatus shown in FIG. 6.

Referring first to FIG. 1 through FIG. 5, a first embodiment 10 of the apparatus for folding paper items in accordance with the present invention. The apparatus 10 includes a paper holding tray 12 with a generally planar top surface 14. Preferably, the tray 12 includes a front edge 16, a back edge 18, a first side 20, and a second side 22. The corners adjacent the front edge 16 of tray 12 are beveled, rounded off, or generally cut away to form a first truncated corner 24 interposed between front edge 16 and first side 20, and a second truncated corner 26 interposed between front edge 16 and second side 22. As shown in FIG. 1 and FIG 2, first and second truncated corners 24, 26 are generally of arcuate, concave shape relative to front edge 16 and first and second sides 20, 22. However, additional shapes, such as rounded, convex, or beveled are also contemplated for truncated corners 24, 26.

Paper holding tray 12 generally includes first and second rear wall members 28, 30 on the top surface 14 adjacent the back edge 18. Tray 12 also generally includes a first side wall member 32 and a second side wall member 34, adjacent first and second sides 20, 22 respectively. First rear wall member 28 and first side wall member 32 are preferably contiguous as shown, and second rear wall member 30 and second side wall member 34 are also preferably contiguous, defining a lip or skirt which partially surrounds or encircles top surface 14 of tray 12 to form a paper receiving recess on the top surface 14 of tray 12. First and second rear wall members 28, 30 are preferably tapered in shape from sides 20, 22 inward towards the central portion of tray 12 adjacent back edge 18.

A folding guide 36 is included on top surface 14 of tray 12. Preferably, folding guide 36 includes a first end 38 and a second end 40, and is of generally flat rectangular configuration. Folding guide 36 is generally positioned longitudinally across tray 12 from back edge 18 to front edge 16, with first end 38 of folding guide 36 extending out over front edge 16 so that first end 38 may be grasped by a user. The second end 40 of folding guide 36 fits between rear wall members 28, 30. First end 38 of folding guide 36 is preferably structured and configured to be conveniently handled by a user, and may include indentations (not shown) or like arrangements to accommodate a user's fingers and thumb. Generally, at least two ridges 44, 46 are included on top surface 14 of tray 12, and run longitudinally from back end 18 to from end 16 of tray 12. Folding guide 36 preferably fits between ridges 44, 46.

Figure 11:
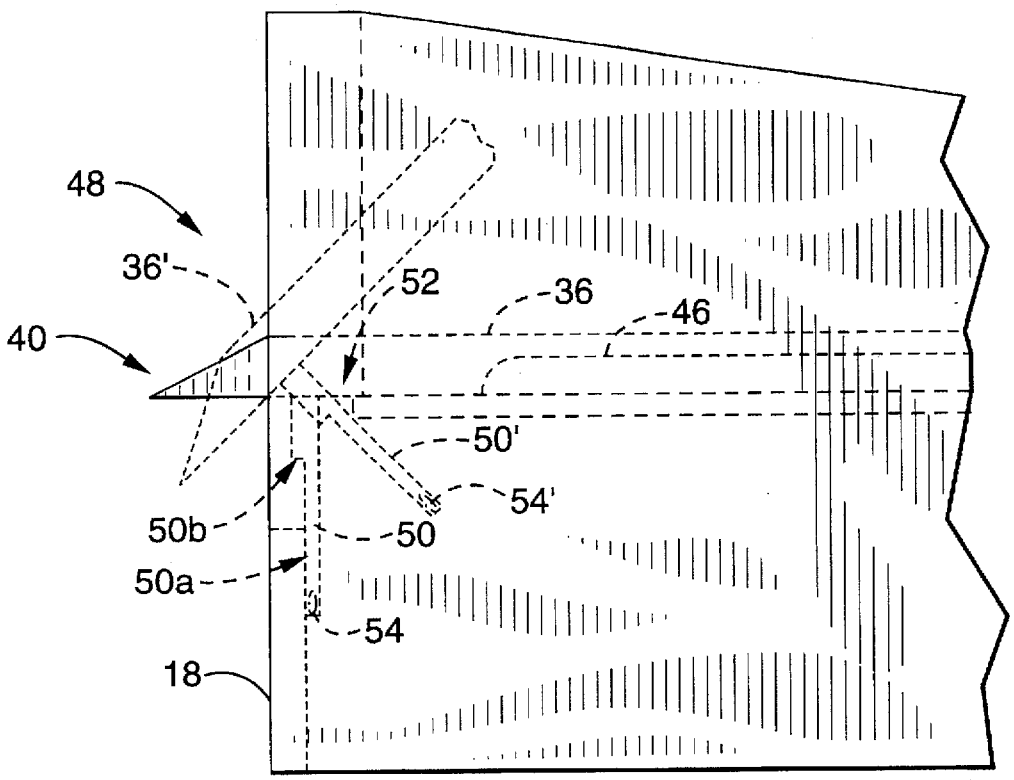
FIG. 11 is a partial side view of the apparatus of the present invention, diagrammatically showing a hinge arrangement employed with the invention.
Figure 12:
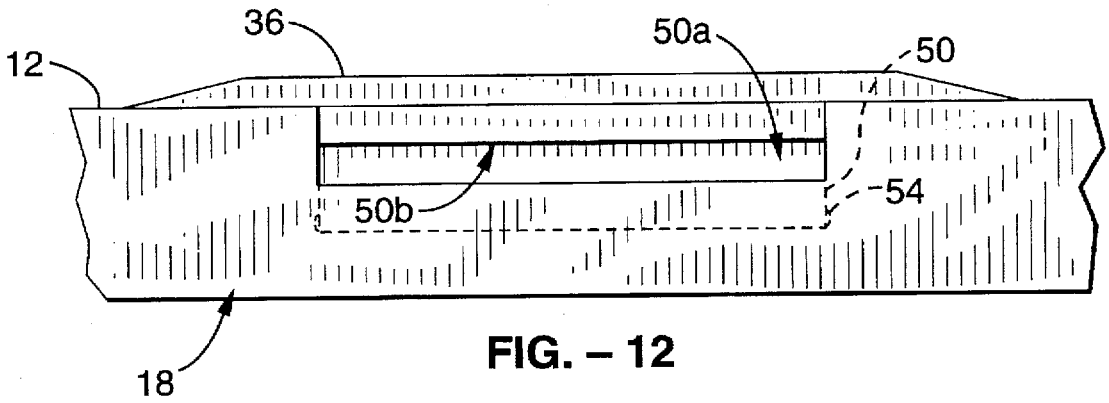
FIG. 12 is a partial rear view of the hinge arrangement shown in FIG. 11.
Figure 13:
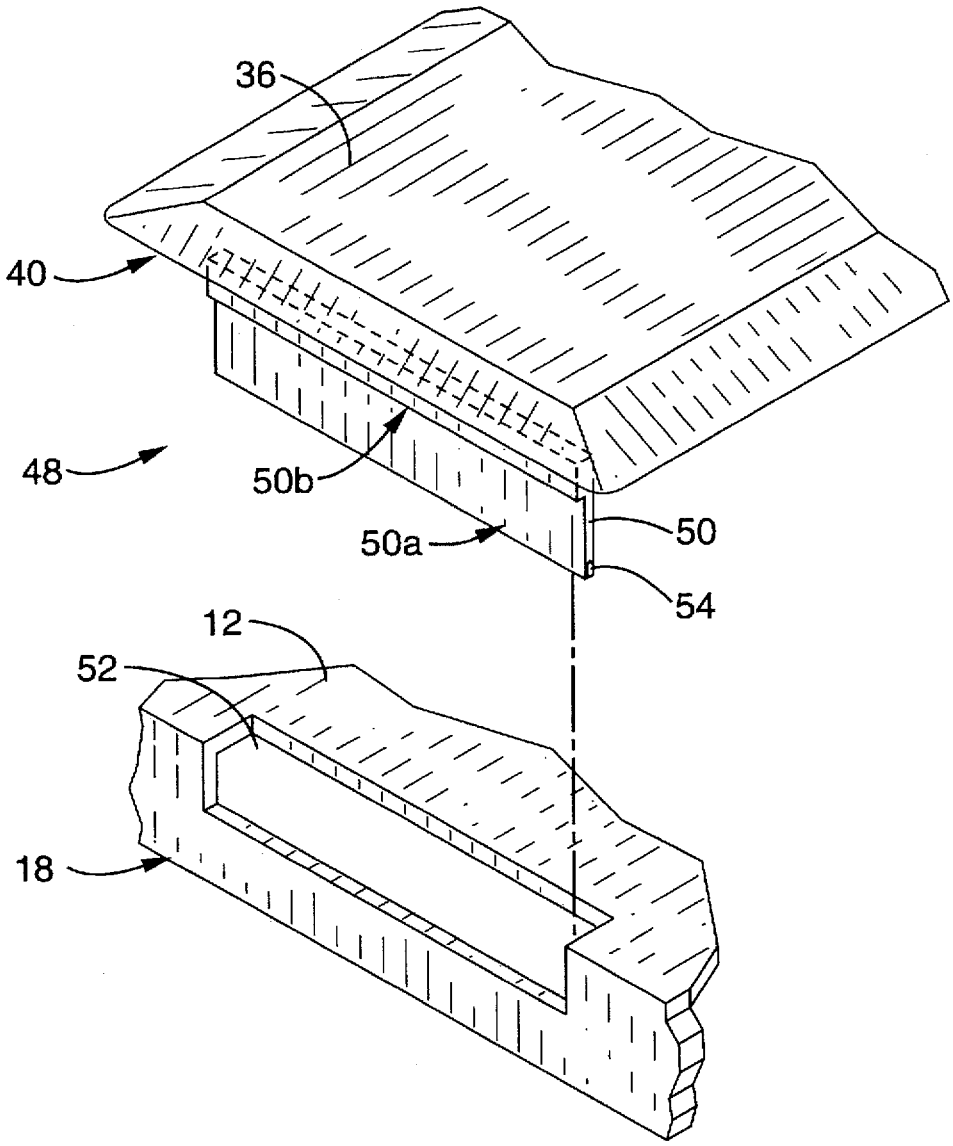
FIG. 13 is a partial exploded view of the hinge arrangement of FIG. 11.

Referring next to FIG. 11 through FIG. 13, articulating hinge means for pivotally attaching folding guide 36 to tray 12 is generally shown as hinge arrangement 48 (FIG. 11). Hinge 48, which is diagrammatically shown in both resting and lifted (pivoted) positions in FIG. 11, preferably includes a pivoting member 50 which is coupled to folding guide 36 adjacent folding guide second end 40. Pivoting member 50 preferably includes a tongue **50*a* which extends into slot 52, the vertical length of tongue 50*a* determining the number of sheets of paper which may be placed beneath the folding guide 36 before it will no longer fit into slot 52. In addition, pivoting member 50 includes a ledge 50*b* which spans the width of tongue 50*a*. The width of ledge 50*b* preferably matches that of slot 52 so as to reduce the amount of lateral play of pivoting member 50 in slot 52. Further, the thickness of tongue 50*a* below ledge 50*b* controls the amount of lateral play of folding guide 36** when grasped at the front and pivoted.

Slot 52 is preferably located in tray top surface 14 adjacent rear edge 18 and between paper rear wall members 28, 30. If desired, a boss or protrusion 54 may be included on pivoting member 50 to prevent pivoting member 50 from disengaging from slot 52. Other articulating hinge means are also contemplated, such as hinges based on pintle and gudgeon arrangements, spring or bias arrangements, resilient connecting members, ball and socket hinges, and like pivotal attachment means generally used in the art. Alternatively, it is contemplated that folding guide 36 may pivot relative to tray 12 without a hinge mechanism. This could be accomplished, for example, if first and second rear wall guides 28, 30 were extended across the rear edge 18 of tray to form a continuous single rear wall guide (not shown) defining a corner with tray top surface 14. Second end 40 of folding guide 36 could then pivot in this corner. Referring particularly to FIG. 13, it can be seen that hinge 48 provides for a "floating" attachment between folding guide 36 and tray 12. As indicated above, tongue **50*a* fits into slot 52 and the vertical height of tongue 50*a* determines the number of sheets of paper that can be placed beneath folding guide 36 before tongue 50*a* will no longer fit into slot 52. This configuration permits folding guide 36 to effectively "float" above top surface 14 of tray 12 and lay on top of the sheets of paper in a substantially parallel orientation to the sheets of paper and the top surface 14 of tray 12. In other words, folding guide 36** will rest flat on top of the sheets of paper even though the number of sheets of paper and the resulting height of the paper stack can vary.

The apparatus for folding paper items is utilized by grasping the first end 38 of folding guide 36 and lifting it up from tray 12 as second end 40 of folding guide 36 pivots on hinge arrangement 48. A plurality of paper items such as flat, rectangular paper sheets 56 (FIG. 5) are placed on tray top surface 14 by a user's hand H. The paper sheet 56 slides between side wall members 32, 34 and comes to rest or abut against rear wall members 28, 30. The paper sheet 56 will thus be oriented and positioned so that corners of the paper sheet 56 project out over first and second truncated corners 24, 26, so that a user can grasp the corners of the paper sheet 56. The paper sheets 56 settles between ridges 44, 46, causing the paper sheets to dimple in the center. Folding guide 36 is then placed back down upon paper sheet 56.

The paper sheet 56 is then grasped by a user, generally along the portions of sheet 56 which protrude over first and second truncated corners 24, 26 and along the portion of the paper between first and second rear wall members 28, 30. First and second rear wall members 28, 30 may include recessed or beveled portions 58 (FIG. 1 and FIG. 3) of concave shape which allow facile handling of the paper sheet 56 while in tray 12. One end of the top sheet of paper is then directed over folding guide 36, and pressed down thereupon to form a crease. The other end is next directed over folding guide 36 and also pressed down upon the folding guide. Folding guide 36 preferable has tapered edges 60 (FIG. 3 and FIG. 4) to aid in forming creases in the paper sheets 56. Either the portion of paper sheet 56 adjacent first side wall member 32 or the portion adjacent second side wall member 34 may be folded and creased first, depending upon the folding pattern desired.

Preferably, folding guide 36 is structured and configured so that it may undergo a small amount of lateral movement or play on hinge 48, so that left handed and right handed users achieve identical folding patterns. It is generally contemplated that, for this purpose, hinge 48 should allow about 15 mil or 15/1000 inch of lateral play. For example, pivoting member 50 would preferably have about 15 mil of lateral play within slot 52.

First and second rear wall members 28, 30 and first and second side wall members 32, 34 may be varied in structure, configuration, and location relative to each other and relative to top surface 14 of tray 12 in order to accommodate a variety of sizes and shapes of paper items to be folded. Generally, rear wall members 28, 30 and side wall members 32, 34 will be arranged so that tray top surface 14 can accommodate a plurality of rectangular sheets of sizes commonly used in mail correspondence, such as 8.5 inch by 11 inch, 11 inch by 14 inch, and 11 inch by 17 inch sheets. However, different arrangements of these members are contemplated to accommodate different sizes and shapes of paper items, including non-rectangular shapes, which could also be folded by using the present invention.

Manufacture of the present invention is simple due to the small number of parts. Generally, the paper receiving tray 12 together with rear wall members 28, 30 and side wall members 30, 32 may be fabricated as a single integral part, and the folding guide 36 and pivoting member 50 as a separate part. Preferably, both parts are molded from a high performance polymeric material such as ABS triblock copolymer, or an engineering resin such as polyether sulfone, poly-ether-ether-ketone (PEEK), liquid crystalline polyester (LCP), and like resin. Chopped glass or carbon fibers may be included with the resin to form composite material to enhance mechanical properties, if desired. Materials used for the hinge 48 will preferably be resistant to wear, fatigue, and failure, such as ABS triblock or glass filled LCP. Suitable pigments and fillers may be compounded into the materials used for molding the parts of the present invention, in order to provide desired colors and textures which are compatible with various office environments. Business logos or trade names may be molded directly into the parts, if desired, or placed thereon after fabrication by decal or other means. Alternatively, the tray folding guide portions of the present invention may be worked from wood or metal and polished to provide a particularly aesthetic appearance. Enamel may be included on metal parts, if used, to vary the appearance of the present invention to complement office decoration schemes.

Referring now to FIG. 6 through FIG. 10, an alternative embodiment 62 of the present invention is generally shown. In this embodiment, first and second front wall members 64, 66 are included on the top surface 70 of tray 68, adjacent to front edge 72. Folding guide 74 fits between front wall members 64, 66 so that first end 76 of folding guide 74 extends between first and second front wall members 64, 66 and out over front edge 72 of tray 68. First and second front wall members 64, 66 are generally discontinuous with first and second side wall members 78, 80, so that openings 82, 84 are defined at first and second truncated corners 86, 88 respectively. Openings 82, 84 are generally structured and configured to allow the corners of conventional rectangular paper sheets to protrude through openings 82, 84 and out over truncated corners 86, 88. Front wall members 62, 64, together with rear wall members 90, 92 and side wall members 78, 80 form an upwardly disposed lip which generally encircles tray 68 and defines a paper receiving recess on tray top surface 70.

Figure 10:
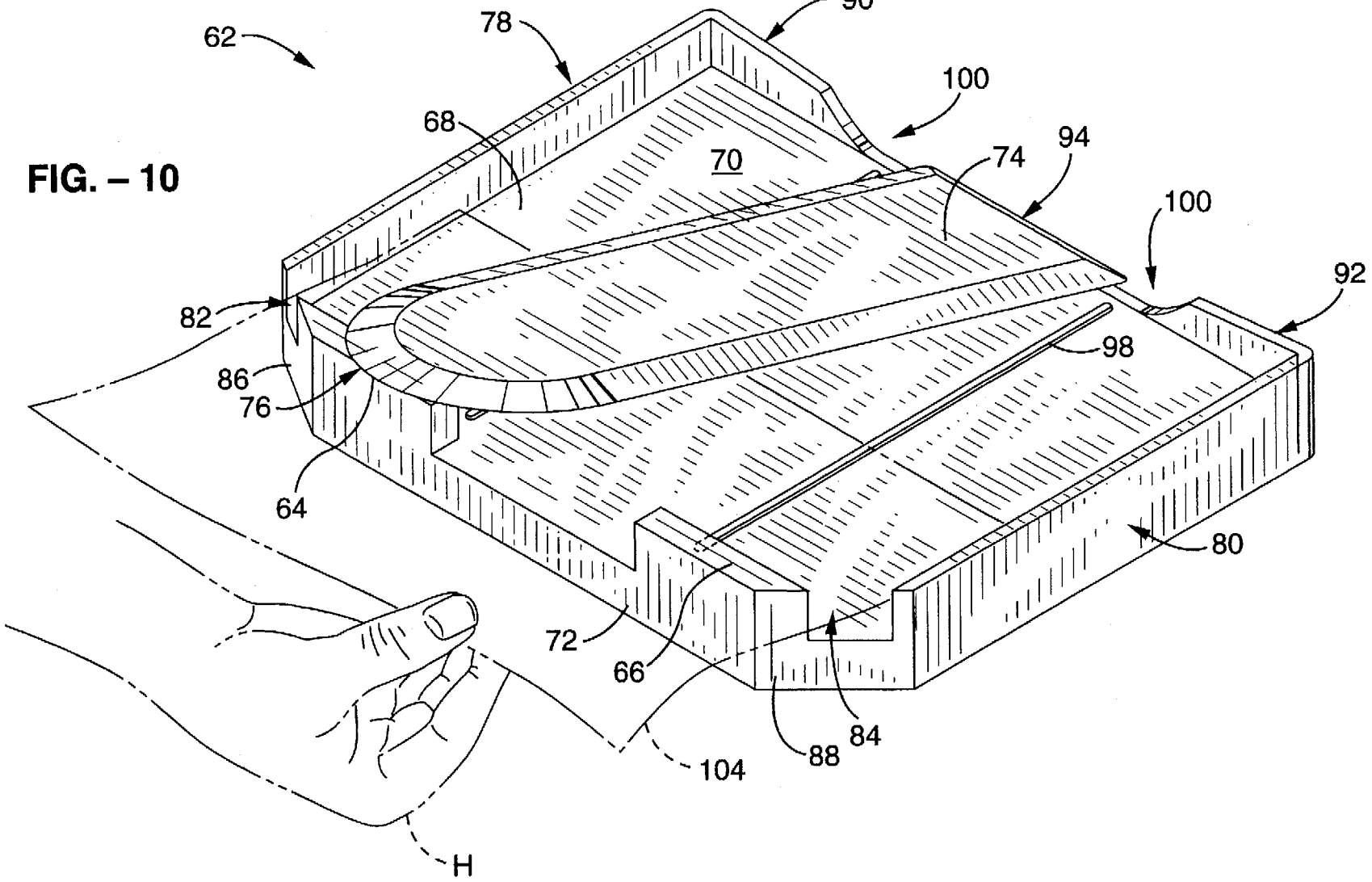
FIG. 10 is a perspective view of the apparatus shown in FIG. 6, showing a user inserting paper sheets into the apparatus.

The embodiment of the present invention shown in FIG. 6 through FIG. 10 is used in generally the same manner as described above for the first embodiment shown in FIG. 1 through FIG. 5. The primary difference between the first and second embodiments is the presence of first and second front wall members 62, 64 on the front edge 72 of tray 68, which help define a paper receiving recess on tray top surface 70. Hinge 48, as shown in FIG. 11, may be employed with the second embodiment in the same manner as related above for the first embodiment, with a pivoting member (not shown) coupled to folding guide 72 adjacent second end 94. The second embodiment includes ridges 96, 98 on tray top surface 70, and beveled portions 100 on rear wall members 90, 92 to aid in paper folding as described above. Tapered edges 102 (FIG. 8) on folding guide 74 allow facile creasing of paper sheets 104 (FIG. 10).

Accordingly, it will be seen that the present invention provides an apparatus for folding paper items, which is quick, easy, and safe to use, is simple to fabricate, and which is aesthetically compatible with a variety of work environments. Although the description above includes many specificities, these should not be construed as limiting the scope of the invention but as merely providing illustrations of some of the presently preferred embodiments of this invention. Thus, the scope of this invention should be determined by the appended claims and their legal equivalents.

What is claimed is:

1. An apparatus for folding a generally planar sheet of material, comprising:

(a) tray means for supporting at least one planar sheet in position for folding, said tray having front and back edges and a top surface;

(b) a plurality of wall members extending upward from said tray and positioned to be abutted by and register the sheet in position for folding on said tray; and (c) a folding guide coupled to said tray and configured to move from an open position wherein the sheet can be positioned and registered on the tray and a closed position to overlay the positioned and registered sheet for folding of the sheet about the folding guide said folding guide having front and back ends; and (d) articulating hinge means for coupling said folding guide to said tray wherein said folding guide can be raised vertically in relation to said top surface of said tray while maintaining a substantially parallel alignment with said sheet and said top surface of said tray, and wherein said front end of said folding guide can be pivotally raised and lowered in relation to said back edge of said tray.

2. An apparatus as recited in claim 1, wherein said articulating hinge means comprises:

(a) a slot positioned in said top surface of said tray adjacent said rear edge, and (b) a pivoting member coupled to said folding guide adjacent said rear end, said pivoting member including a tongue extending into said slot, said pivoting member including a ledge which spans the width of said tongue and said slot.

3. An apparatus for folding paper items, comprising:

(a) a paper holding tray, said tray including front and back edges, said tray including first and second sides, said tray including a top surface, said tray including a first cutout portion extending between said front edge and said first side, said tray including a second cutout portion extending between said front edge and said second side;

(b) a first rear wall member and a second rear wall member, said rear wall members included on said top surface of said tray, said rear wall members adjacent said back edge of said tray;

(c) a first side wall member and a second side wall member, said side wall members included on said top surface of said tray, said first side wall member adjacent said first side of said tray, said second side wall member adjacent said second side of said tray;

(d) a paper folding guide, said folding guide having a first end and a second end, said folding guide included on said top surface of said tray, said second end of said folding guide positioned adjacent said back edge of said tray, said first end of said folding guide extending out over said front edge of said tray; and (e) articulating hinge means for coupling said folding guide to said tray wherein said folding guide can be raised vertically in relation to said top surface of said tray while maintaining a substantially parallel alignment with a sheet of paper placed between said paper folding guide and said top surface of said tray, and wherein said first end of said folding guide can be pivotally raised and lowered in relation to said back edge of said tray.

4. An apparatus as recited in claim 3, further comprising a first slot between said first and second rear wall members, said second end of said paper folding guide fitting in said first slot.

5. An apparatus as recited in claim 4, wherein said first rear wall member is tapered in shape from said first side towards said first slot, and said second rear wall member is tapered in shape from said second side towards said first slot.

6. An apparatus as recited in claim 3, wherein said top surface of said tray includes at least two parallel ridges on said top surface of said tray extending between said front edge and said back edge of said tray, said paper folding guide fitting between said parallel ridges.

7. An apparatus as recited in claim 3, further comprising a first front wall member and a second front wall member, said front wall members adjacent said front edge of said paper tray, said first front wall member adjacent said first cutout portion and said front edge, said second front wall member adjacent said second cutout portion and said front edge, said paper folding guide fitting in a slot between said front wall members.

8. An apparatus as recited in claim 3, wherein said articulating hinge means comprises:

(a) a second slot, said second slot positioned in said top surface of said tray adjacent said rear edge, and (b) a pivoting member coupled to said folding guide adjacent said rear end, said pivoting member including a tongue extending into said second slot, said pivoting member including a ledge which spans the width of said tongue and said second slot.

9. An apparatus for folding paper items, comprising:

(a) a paper holding tray, said tray including front and back edges, said tray including first and second sides, said tray including a top surface, a first cutout portion extending between said front edge and said first side, said tray including a second cutout portion extending between said front edge and said second side;

(b) a first rear wall member and a second rear wall member, said rear wall members included on said top surface of said tray, said rear wall members adjacent said back edge of said tray;

(c) a first side wall member and a second side wall member, said side wall members included on said top surface of said tray, said first side wall member adjacent said first side of said tray, said second side wall member adjacent said second side of said tray;

(d) a paper folding guide, said folding guide having a first end and a second end, said folding guide included on said top surface of said tray, said second end of said folding guide positioned adjacent said back edge of said tray, said first end of said folding guide extending out over said front edge of said tray; and (e) articulating hinge means for coupling said folding guide to said tray wherein said folding guide can be raised vertically in relation to said top surface of said tray while maintaining a substantially parallel alignment with a sheet of paper placed between said paper folding guide and said top surface of said tray, and wherein said first end of said folding guide can be pivotally raised and lowered in relation to said back edge of said tray.

10. An apparatus as recited in claim 9, further comprising a first slot between said first and second rear wall members, said second end of said paper folding guide fitting in said first slot.

11. An apparatus as recited in claim 10, wherein said first rear wall member is tapered in shape from said first side towards said first slot, and said second rear wall member is tapered in shape from said second side towards said first slot.

12. An apparatus as recited in claim 10, further comprising a first front wall member and a second front wall member, said front wall members adjacent said front edge of said paper tray, said first from wall member adjacent said first cutout portion and said front edge, said second front wall member adjacent said second cutout portion and said front edge, said first and second front wall members defining a slot between said front wall members, said paper folding guide fitting in said slot between said front wall members.

13. An apparatus as recited in claim 9, wherein said top surface of said tray includes at least two parallel ridges on said top surface of said tray extending between said front edge and said back edge of said tray and forming a grove, said paper folding guide fitting into said groove.

14. An apparatus as recited in claim 9, wherein said articulating hinge means comprises:

(a) a second slot, said second slot positioned in said top surface of said tray adjacent said rear edge, and (b) a pivoting member coupled to said folding guide adjacent said rear end, said pivoting member including a tongue extending into said second slot, said pivoting member including a ledge which spans the width of said tongue and said second slot.

* * * * *